US006823800B2

(12) United States Patent
Berg et al.

(10) Patent No.: US 6,823,800 B2
(45) Date of Patent: Nov. 30, 2004

(54) SPRING SEAT FOR A RAILWAY TRUCK SIDEFRAME AND METHOD OF MAKING THE SAME

(76) Inventors: Thomas R. Berg, 1120 Dunwoody Dr., St. Louis, MO (US) 63122; Anthony J. Bauer, 7131 Horseshoe Bend Rd., Edwardsville, IL (US) 62025; Thomas R. Callahan, 1008 Robert Dr., Maryville, IL (US) 62062; Hector Chaidez, 2705 Keebler Rd., Marysville, IL (US) 62062; Ralph H. Schorr, 3413 Wilderness Dr., Edwardsville, IL (US) 62025

( * ) Notice: Subject to any disclaimer, the term of this patent is extended or adjusted under 35 U.S.C. 154(b) by 43 days.

(21) Appl. No.: 10/405,664

(22) Filed: Apr. 2, 2003

(65) Prior Publication Data

US 2003/0200894 A1 Oct. 30, 2003

Related U.S. Application Data

(60) Provisional application No. 60/370,268, filed on Apr. 5, 2002.

(51) Int. Cl.[7] ..... B61F 3/00

(52) U.S. Cl. ..... 105/206.1; 105/197.05

(58) Field of Search ..... 105/206.1, 230, 105/197.05, 197.1, 198.1, 198.2, 198.4, 198.7

(56) References Cited

U.S. PATENT DOCUMENTS

| | | | | | |
|---|---|---|---|---|---|
| 1,964,184 | A | * | 6/1934 | Shafer | 105/197.05 |
| 2,108,653 | A | * | 2/1938 | Couch | 105/197.1 |
| 2,283,332 | A | * | 5/1942 | Light | 105/198.2 |
| 3,461,814 | A | * | 8/1969 | Brown | 105/193 |
| 3,654,870 | A | * | 4/1972 | Wallace | 105/198.4 |
| 4,363,276 | A | | 12/1982 | Neumann | |
| 4,838,174 | A | | 6/1989 | Moehling | |
| 4,915,031 | A | * | 4/1990 | Wiebe | 105/198.2 |
| 5,481,986 | A | | 1/1996 | Spencer et al. | |
| 5,718,177 | A | | 2/1998 | Wronkiewicz et al. | |
| 5,752,564 | A | | 5/1998 | Callahan et al. | |
| 5,791,258 | A | * | 8/1998 | Hawthorne et al. | 105/198.7 |
| 5,967,053 | A | | 10/1999 | Toussaint et al. | |
| 6,089,166 | A | | 7/2000 | Callahan et al. | |
| 6,125,767 | A | | 10/2000 | Hawthorne et al. | |

* cited by examiner

*Primary Examiner*—Mark T. Le
(74) *Attorney, Agent, or Firm*—Edward J. Brosius

(57) ABSTRACT

A cast metal sideframe for use in a railway car truck has a spring seat for supporting the springs of a spring set. The sideframe is molded using a core that includes a portion for defining the exterior surface of the spring seat. The core can be a single piece or multi-piece core. The spring seat includes a plurality of aerodynamically-shaped spring retainers formed on the top face spring seat. The aerodynamic shape of the spring retainers reduces the tendency for sand to swirl and create voids during formation of the sand core that is used to mold the sideframe. The aerodynamic shape may include forming at least some of the side walls of the spring retainers at an obtuse angle with the top face of the spring seat. The spring retainers may have concave top faces so as to reduce the volume of material comprising the spring retainers. Reducing material volume is beneficial for reducing shrinkage during cooling of the sideframe, thereby reducing the tendency for separation, tears and cracks to form on the top surface of the spring retainer.

16 Claims, 11 Drawing Sheets

SPRING SEAT FOR A RAILWAY TRUCK SIDEFRAME AND METHOD OF MAKING THE SAME

RELATED APPLICATIONS

This application claims priority of Provisional Application Serial No. 60/370,268 which was filed Apr. 5, 2002. The entire disclosure of the Ser. No. 60/370,268 provisional application is hereby incorporated by reference.

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

Railway freight car trucks are usually configured in a three-piece arrangement consisting of a pair of laterally spaced sideframes, a bolster extending between the sideframes, and a pair of wheel sets located at opposite ends of the sideframes. Each sideframe includes a centrally located bolster opening for receiving the end of a bolster that extends laterally between and perpendicular to the sideframes. The ends of the sideframes are laterally aligned to receive an axle wheel set in what is usually termed the pedestal jaw of the sideframe. Examples of typical railway trucks are shown in U.S. Pat. Nos. 4,363,276; 4,838,174; 5,718,177; and 6,125,767.

A typical sideframe is comprised of an elongated top compression member that extends in a longitudinal direction parallel to the railway track. The sideframe also comprises two diagonally extending tension members that extend generally downwardly at an acute angle from near the ends of the top compression member. A bottom member extends longitudinally and joins the lower ends of the diagonal tension members. Column members extend generally vertically between the bottom member and the top compression member from a point near the junction of the diagonal tension members and the bottom member. Such column members form the bolster opening in the sideframe. A top portion or face of the bottom member of a sideframe is usually referred to as the spring seat of the sideframe, as it is adapted to receive the spring set upon which the ends of the bolster are supported. The bolster extends laterally between each sideframe with the ends of the bolster extending into the bolster openings where it is supported on spring sets. The spring seat includes upstanding structure, commonly referred to as spring retainers, for positioning and supporting the springs of the spring set. One example of a known spring retainer is shown in FIG. 2. Another example of a known spring retainer 2 is shown in FIGS. 3–5. As can be seen, the spring retainers 1, 2 generally comprise of upstanding flanges formed on the upper face of the spring seat 3, 4. As is shown in FIGS. 3 and 4, the spring seat 3 may also include depressions or recesses 5 for receiving the bottom faces of the springs. The arcuate broken lines 6 in FIG. 3 generally represent the springs from the spring set.

In order to reduce the overall weight of the railway truck, many of the components, such as the sideframes, are formed as hollow metal castings. Examples of processes for casting such components can be found in U.S. Pat. Nos. 5,481,986 and No. 5,752,564. As is described in the '564 patent, such castings are created using molds consisting of sand cores supported between cope and drag mold portions. The cope and drag portions of the mold define a mold cavity. The sand cores are supported within the mold cavity and used to form the hollows and open spaces in the castings.

The sand cores are made in a core box consisting of cope and drag portions. The core box is filled, e.g., by a blower, with a mixture of sand and binder. The mixture is then cured to harden the resulting sand core sufficiently to allow it to be used for molding the cast component, e.g. the sideframe. As will be appreciated, the resulting cores have a negative image of the casting.

Problems can arise during the manufacture of the sand cores that are used to form these prior spring seats and spring retainers. Specifically, as can be seen in FIGS. 2–5, the prior spring retainers 1, 2 present abrupt, vertical surfaces that are generally perpendicular to the sand flow during creation of the sand cores. These vertical faces cause the sand to swirl as it is blown into the mold, thereby creating voids in the sand core and corresponding defects in the cast metal component.

The present invention addresses various aspects of these problems in the prior art.

BRIEF SUMMARY OF THE INVENTION

Certain aspects of an embodiment of the present invention relate to an improved cast metal sideframe for use in a railway car truck. The sideframe has a spring seat for supporting springs from a spring set. The sideframe is molded using a core that includes a portion for defining the exterior surface of the spring seat. The spring seat includes a plurality of aerodynamically-shaped spring retainers formed on the spring seat. The aerodynamic shape of the spring retainers reduces the tendency for voids to form in the sand cores that are used to cast the sideframe.

The spring retainer may have a concave top face, which reduces the volume of material comprising the spring retainer. Reducing material volume is beneficial for reducing shrinkage during cooling of the sideframe, thereby reducing the tendency for separation, tears and cracks to form on the top surface of the spring retainer.

The aerodynamic shape may include forming portions of the retainer's side wall at an obtuse angle with the top face of the spring seat. In one embodiment, the spring seat has an outer end, an inner end and a top face. The spring retainer may include a first face facing the outer end of the spring seat and a second face facing the inner end of the spring seat. The first and second faces of the spring retainer preferably form obtuse angles with respect to the top face of the spring seat. The first and second faces are generally transverse to the direction that sand flows during formation of the sand cores that are used to mold the sideframe. As a result, the tendency for sand to swirl and create voids during formation of the sand cores is reduced.

The spring retainers may include arcuate side walls for engaging and supporting springs from the spring set. Arcuate recesses may be formed in the top face of the spring seat, adjacent the arcuate side walls, for receiving the bottom faces of the springs.

Another aspect of the present invention relates to a method of making hollow cast metal sideframes of the type having a spring seat for supporting springs from a spring set. The method comprises the steps of providing a core to define the hollow interior of the sideframe, providing a mold with cope and drag portions and cop and drag mold surfaces defining a mold cavity, placing the core in the mold cavity, pouring molten metal into the mold to form a sideframe casting, removing the casting from the mold, and separating the casting from the core. The core comprises a spring seat portion for defining the exterior surface of the spring seat such that the exterior surface of the spring seat includes a plurality of aerodynamically-shaped spring retainers formed on the spring seat, whereby the aerodynamic shape of the spring retainers reduces the tendency for voids to form in the spring seat portion of the core.

Another aspect of the present invention relates to a method of making hollow cast metal sideframes of the type having a spring seat for supporting springs from a spring set. The spring seat has an outer end, an inner end and a top face. The method comprises the steps of providing a core to define the hollow interior of the sideframe, providing a mold with cope and drag portions and cop and drag mold surfaces defining a mold cavity, placing the core in the mold cavity, pouring molten metal into the mold to form a sideframe casting, removing the casting from the mold, and separating the casting from the core. The core comprises a spring seat portion for defining the exterior surface of the spring seat such that the exterior surface of the spring seat includes a plurality of aerodynamically-shaped spring retainers formed on the spring seat, wherein each aerodynamically-shaped spring retainer has a respective first face facing the outer end of the spring seat and a respective second face facing the inner end of the spring seat, and wherein the first and second faces form obtuse angles with respect to the top face of the spring seat, whereby the aerodynamic shape of the spring retainers reduces the tendency for voids to occur in the spring seat portion of the core.

Another aspect of the present invention relates to a method of making hollow cast metal sideframes of the type having a spring seat for supporting a holding a spring set. The method comprises the steps of providing a core to define the hollow interior of the sideframe, providing a mold with cope and drage portions and cop and drag mold surfaces defining a mold cavity, placing the core in the mold cavity, pouring molten metal into the mold to form a sideframe casting, removing the casting from the mold, and separating the casting from the core, the improvement wherein the core comprises: a spring seat portion for defining the exterior surface of the spring seat such that the exterior surface of the spring seat includes a plurality of spring retainers formed on the spring seat, at least some of the spring retainers having concave top faces, whereby the volume of material comprising the retainer is reduced.

Another aspect of the present invention relates to an improved cast metal sideframe of the type having a spring seat for supporting springs from a spring set. The spring seat comprises a plurality of spring retainers formed on a top face of the spring seat. At least some of the spring retainers having concave top faces, whereby the volume of material comprising the retainer is reduced.

Figure 1:
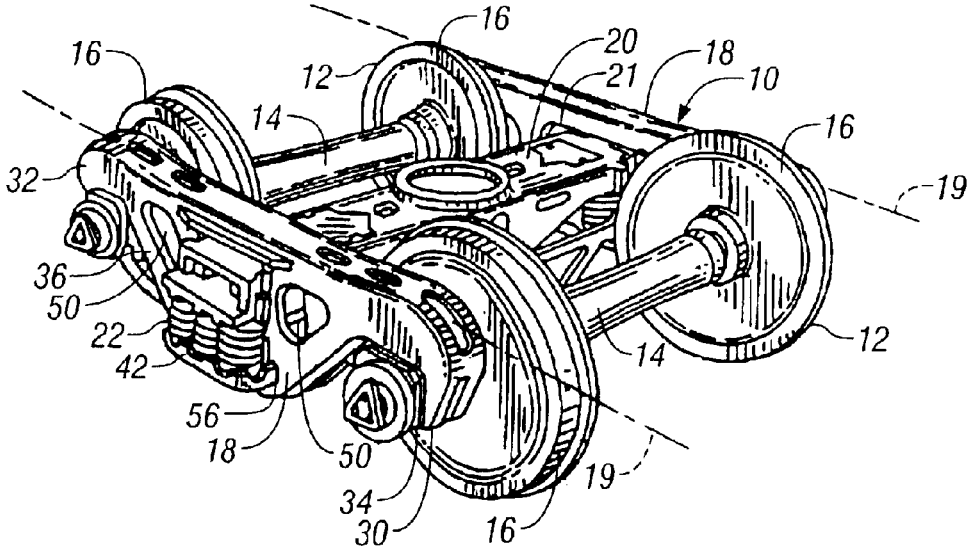
FIG. 1 is a perspective view of a railway car truck, with sideframes and a bolster.
Figure 2:
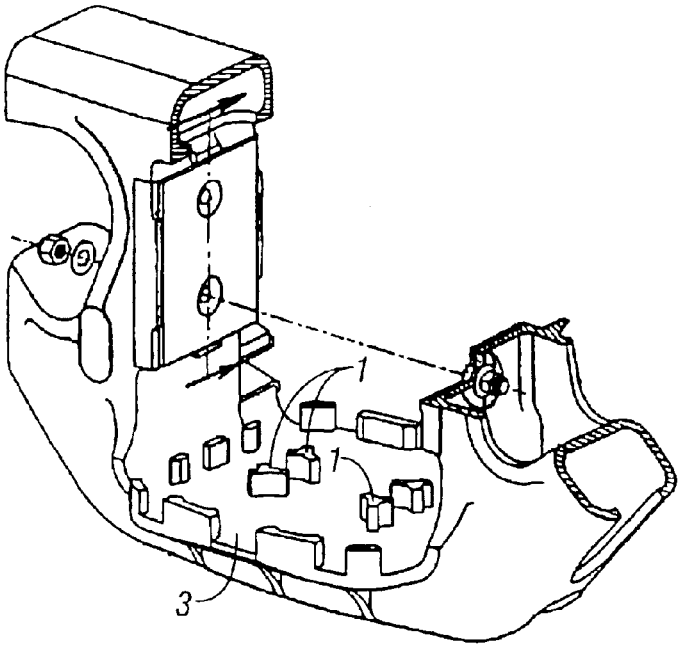
FIG. 2 (Prior Art)
FIG. 2 illustrates a prior art spring seat including a plurality of spring retainers.
Figure 3:
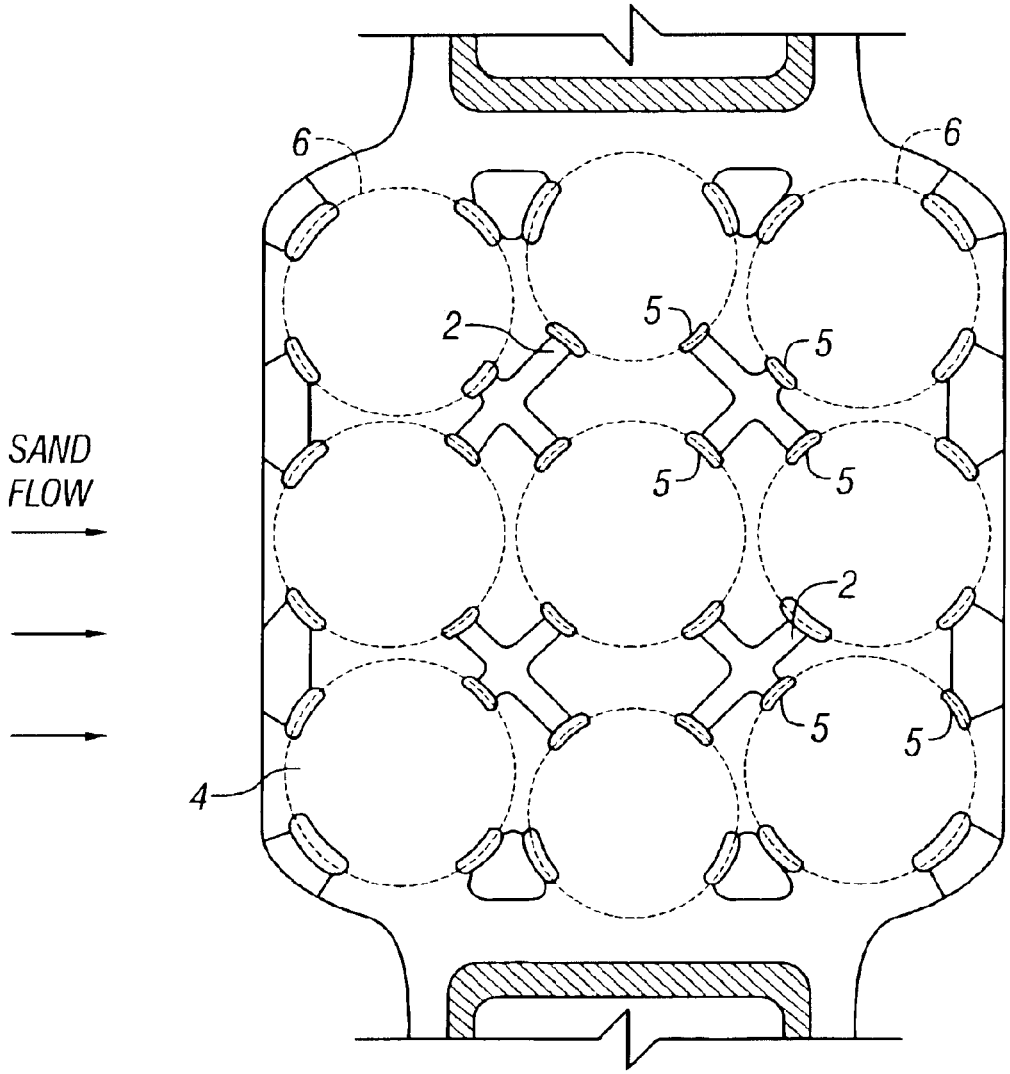
FIG. 3 (Prior Art)
FIG. 3 is a top plan view of another prior art spring seat employing an alternative spring retainer design.
Figure 4:
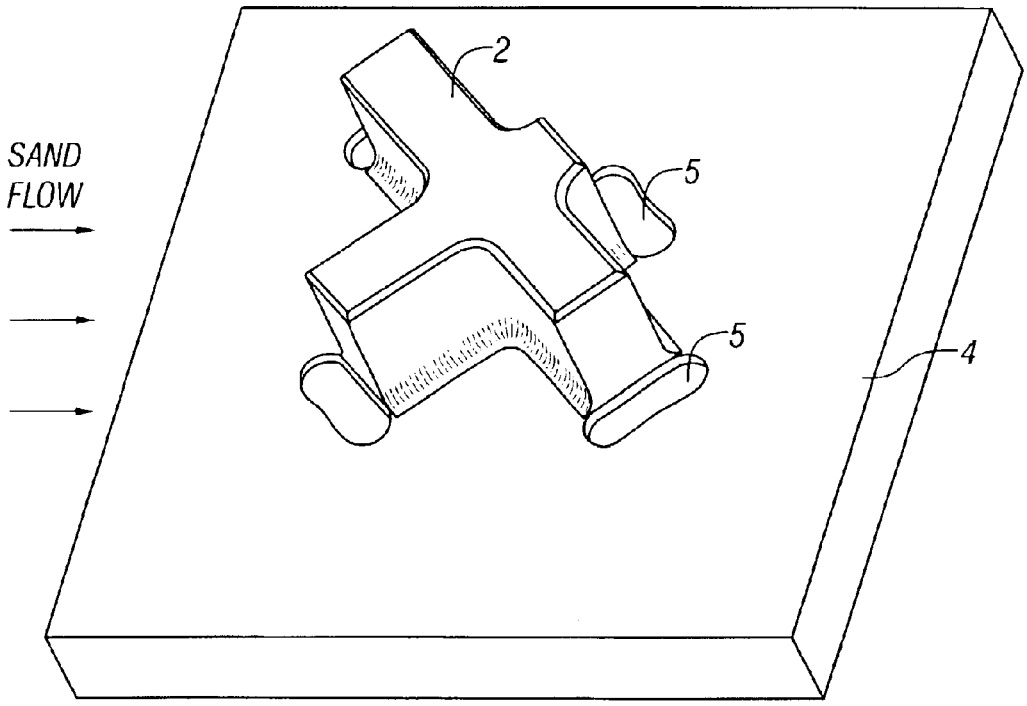
FIG. 4 (Prior Art)
FIG. 4 is a perspective view of one of the spring retainers from FIG. 3.
Figure 5:
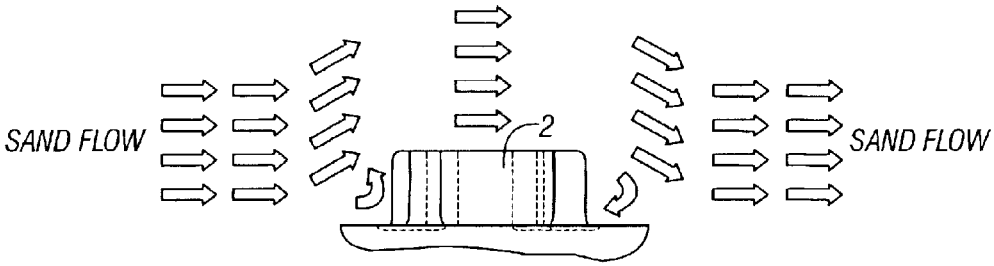
FIG. 5 (Prior Art)
FIG. 5 illustrates the formation of a sand core for molding the spring retainer of FIG. 4.

The foregoing summary, as well as the following detailed description of the preferred embodiments of the present invention, will be better understood when read in conjunction with the appended drawings. For the purpose of illustrating the preferred embodiments of the present invention, there is shown in the drawings, embodiments that are presently preferred. It should be understood, however, that the present invention is not limited to the arrangements and instrumentality shown in the attached drawings.

DETAILED DESCRIPTION OF THE INVENTION

A railway truck 10 that may utilize a cast spring seat according to certain aspects of an embodiment of the present invention is illustrated in FIG. 1. Except as explained below, the railway truck 10 may be constructed generally in accordance with the rail trucks described in U.S. Pat. No. 5,481,986, issued Jan. 9, 1996 to Spencer et al. and entitled "Lightweight Truck Side Frame" (the "'986 Patent) and U.S. Pat. No. 5,752,564, issued May 19, 1998 to Callahan et al. and entitled "Railway Truck Castings and Method and Cores for Making Castings" (the "'564 Patent"). The disclosures of the '986 patent and the '564 patent are hereby incorporated by reference herein in their entirety.

As is shown in FIG. 1, a typical railway truck 10 includes a pair of wheelsets 12. Each wheel set 12 has an axle 14 with wheels 16 at the ends of each axle 14. The two wheelsets 12 support a pair of spaced, parallel sideframes 18. The two sideframes 18 have longitudinal centerlines 19 and are spanned by a bolster 20, which is received in a bolster opening 21 (see FIG. 7) in the middle of each sideframe. The ends of the bolster 20 are supported in the bolster openings 21 by spring sets 22.

Figure 6:
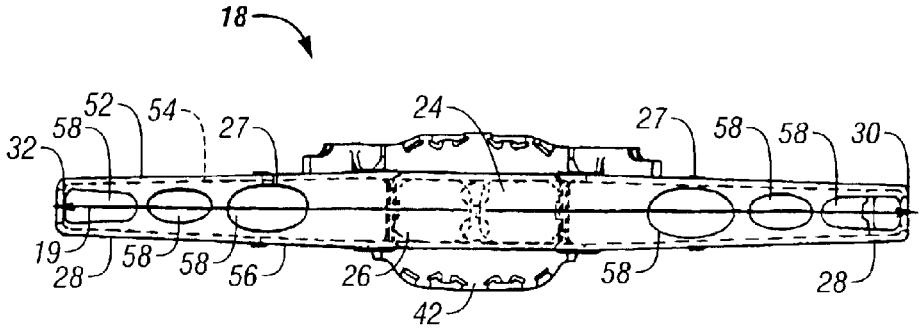
FIG. 6 is a top plan view of a sideframe from FIG. 1.
Figure 7:
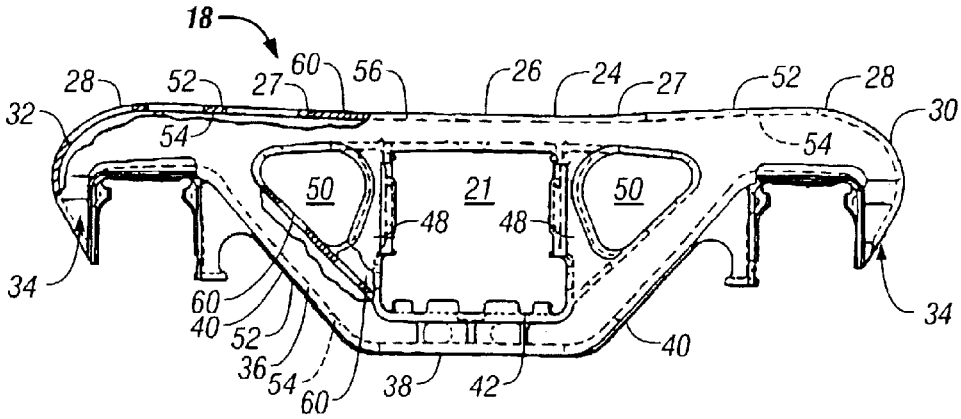
FIG. 7 is a side plan view of the sideframe of FIG. 6.
Figure 8:
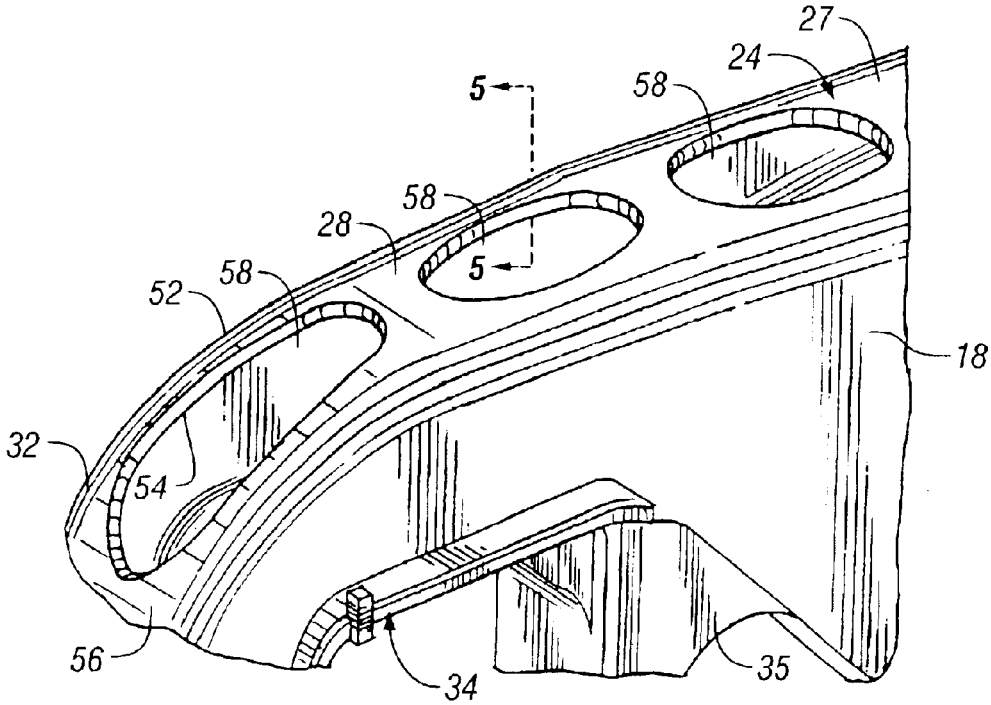
FIG. 8 is an enlarged partial perspective view of the top member of the sideframe of FIG. 6.

As shown in FIGS. 6–8, the sideframe 18 generally includes a top member 24 or compression member having a center portion 26 and two similar top end portions 28 connected with the center portion 26 through compression member portions 27. Pedestal jaws 34 formed at the front and rear ends 30, 32 of the side frame are configured to be mounted on a wheelset 12, as illustrated in FIG. 1.

Each sideframe 18 also includes a tension member or lower member 36 comprised of a bottom center portion 38 and two integral diagonal portions 40. Each of the diagonal bottom portions 40 extends from the bottom center portion 38 toward the pedestals 34. A spring seat 42 is provided on the bottom center portion 38 of the tension member 36, between the bottom center portion 38 and top center portion 26. As was discussed above and as shown in FIG. 1, the middle of the sideframe bolster opening 21 above the spring seat 42 is sized to receive the spring set and the end of the bolster 20. Columns 48 extend between the top member 24 and tension member 36, along each side of the bolster opening 21. Each sideframe 18 also has two side windows 50.

The illustrated sideframe 18 is hollow, with exterior 52 and interior 54 sides or surfaces of its cast metal walls 56. The sideframe 18 may include a plurality of openings in the cast metal walls 56, including lightener openings 58 in the top surfaces of the top member 24.

Figure 9:
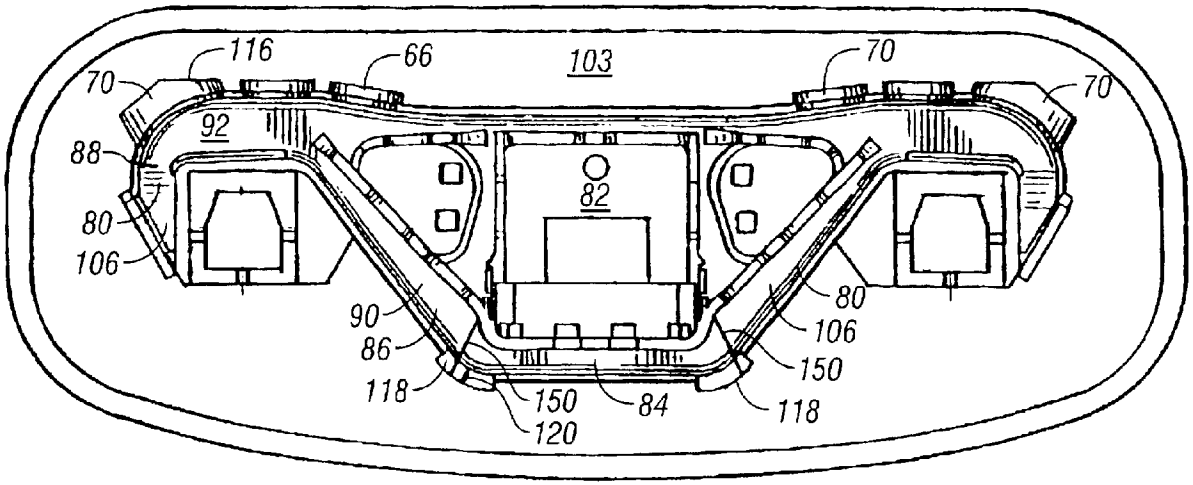
FIG. 9 is a top plan view of four one-piece sideframe cores that may be used to form the sideframe, showing the cores in place in a drag mold flask with other cores.
Figure 10:
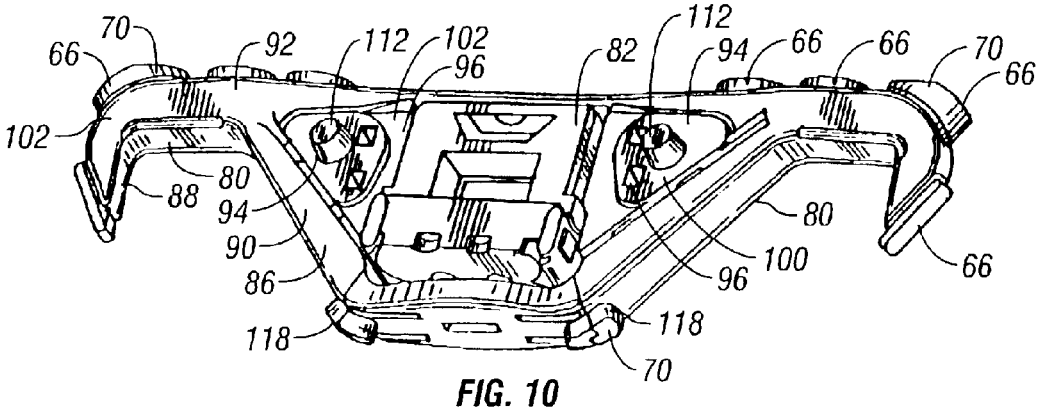
FIG. 10 is a perspective view of the four one-piece sideframe cores, showing the portions that are provided to rest against the drag side of the mold surface.
Figure 11:
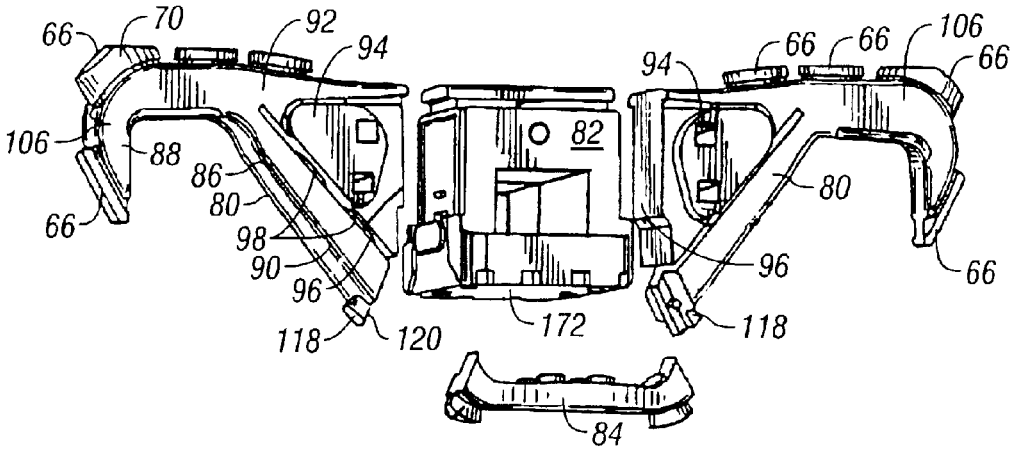
FIG. 11 is an exploded perspective view of the four one-piece sideframe cores, showing the opposite side of cores shown in FIG. 10.

As is shown in FIGS. 9–11, and as is described in greater detail in the '564 patent, the interior surface 54 of the walls of the sideframe top member, tension member and columns may be made using four sand cores; namely, two one-piece sideframe end cores 80, one one-piece sideframe center core 82 and one one-piece bottom center core 84. The cores are placed in a mold cavity defined by cope and mold drag portions. The exterior surface of the sideframe is defined by the cope and mold portions, which provide a negative image of this surface.

Each of the illustrated one-piece end cores 80 has a core body 86 with a pedestal portion 88 for defining an interior surface of the sideframe pedestal 34 at the front 30 or rear 32 end of the sideframe. In the illustrated embodiment, the pedestal portion 88 defines the interior surface of the outer leg of the pedestal jaw 34, the one-piece end core also defines the interior surface of the roof pedestal jaw 34. An integral diagonal tension arm portion 90 serves to define an interior surface of the sideframe's diagonal portion 40 of the tension member 36. A top member portion 92 of the one-piece end core 80 also extends from the pedestal portion 88, and serves to define the interior surface of the top end 28 and compression member 27 portions of the top member 24. The one-piece end core 80 also includes an integral side window support 94 between the diagonal tension arm portion 90, the top portion 92, and a column portion 96. The side window support 94 serves to define one of the side windows 50 of the sideframe 18, and is connected to the diagonal tension arm portion 90 and top portion 92 of the core through necks or bridges (not shown) that define the openings (not shown) in the diagonal portion of the tension arm and underside of the compression portion 27 of the top member 24. The column portion 96 serves to define the interior surface 54 of the column 48 of the cast sideframe.

Figure 9A:
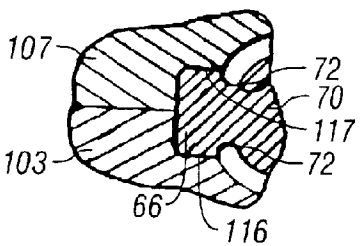
FIG. 9A is an enlarged partial cross-section of a portion of a sideframe core received within the cope and drag portions of a mold.

A side window support 94 has flat surfaces 100 that extend outward beyond the outer surface 68 of the core body 86. These flat surfaces 100 serve to support a part of the weight of the end core 80 on the mold, and lie in a plane spaced from the outer surface 68 of the core body 86 a distance of about one-half inch. Since this surface 100 on the drag side 102 of the core rests on the drag mold surface 103 of the mold cavity 104, and since this surface 100 on the cope side 106 bears against the cope mold surface (designated 107 in FIG. 9A for the cope mold surface at the print 70 on the top member portion 92), this spacing defines the thickness of the metal to be cast in this area of the sideframe. In the illustrated embodiment, these surfaces 100 on both sides 102, 106 of the core lie in planes.

Figure 10A:
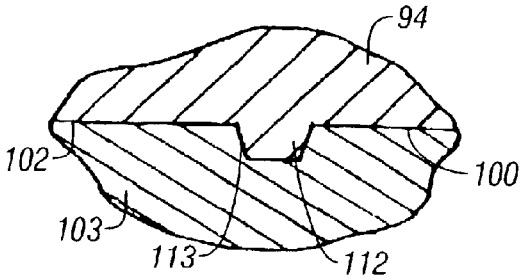
FIG. 10A is a partial cross section view of the one-piece end core of FIGS. 9–10.

As shown in FIG. 10, the side window support 94 on the drag side 102 of the end core 80 also includes a locator boss 112 extending out from the flat support surface 100. The locator boss 112 is received within a mating hole or opening 113 (FIG. 10A) in the drag mold surface 103 of the drag side of the mold to locate and support the core. The illustrated locator boss 112 has the shape of a frustum of a cone, that is, it has a slight draft for ease of making the core and ease of placement of the boss 112 in the mating hole 113. In the illustrated embodiment, as shown in FIG. 9, the cope side 106 of the end core does not have a locator boss, although it should be understood that a cope side locator boss could be provided if desired, along with a mating hole in the cope side of the mold.

Each end core 80 is further supported on the drag mold surface 103 by the core prints 66 corresponding with the lightener openings 58 in the outer surface of the top member 24. Another core print 118 is located at the bottom center core end 120 of the diagonal portion of the tension member. The core print bodies 70 are shaped to be received in mating openings 116 in the drag mold surface 103 and to support a portion of the weight of the end core on the drag mold surface and in mating openings 117 in the cope mold surface 107 (FIG. 9A) to stabilize and position the core with respect to the cope mold surface. The core prints 66, 118, side window supports 94 and locator boss 112 also serve to locate or maintain the position of the end core 80 in the mold during handling and, in combination with the contour of the mold surfaces 103, 107, to define the thickness of the metal to be cast, which may be about one-half inch grade C, B or B+steel, for example, in the illustrated embodiment. In addition, the combination of the illustrated core prints 66, 118 and side window support 94 can support the entire sideframe end core 80 on the drag mold surface 103, without any support chaplets or other device to support or position the core.

Figure 12:
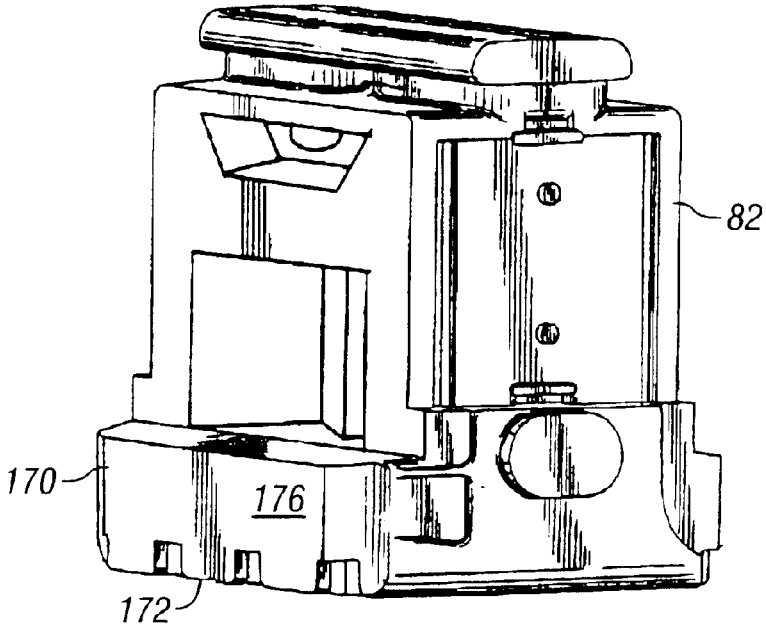
FIG. 12 is a perspective view of the sideframe center core shown in FIGS. 9–10.
Figure 13:
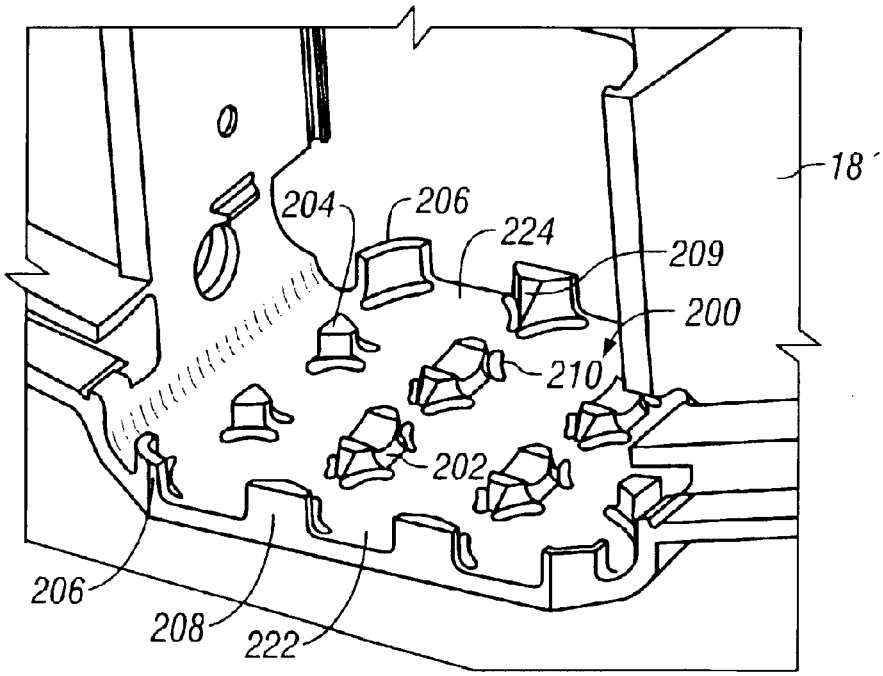
FIG. 13 illustrates a spring seat according to certain aspects of an embodiment of the present invention.

As shown in FIG. 12, the illustrated one-piece sideframe center core 82 includes an integral spring seat element or portion 170 to define the lower bolster opening and top surface of the spring seat 42 in the sideframe 18. The bottom surface 172 of the spring seat element 170 is spaced above the bottom center core 84, and together with mating surfaces in the drag and cope mold surfaces 103, 107, define a cavity in which metal is cast to form the spring seat 42. The spring seat element 170 also has planar support surfaces 176 which support a part of the weight of the center core element 82 on the drag mold surface 103 and mate with the cope mold surface 107 to assure proper positioning of the center core with respect to the mold surfaces.

The cores described above may be used to produce cast metal sideframes by placing the cores in suitable drag molds formed of green sand or other material in the drag side of a flask. A suitable cope side of a flask may then be placed on the combination of the cores and drag flask.

Chaplets may be used to prevent floatation of the bottom center core and to support and locate other cores, such as the cores used to form recesses on the inboard sides of the sideframes to deceive the ends of brake beams, the journal cores and other cores to cooperate with the one-piece end cores to form the complete pedestals jaw 34. Such other cores are illustrated generally in FIG. 9, showing the four cores in position in a drag flask; the details of the other cores are not shown, as those cores may be made and used according to the prior art.

The combinations may be handled as has been done traditionally in the art, and in fact may be moved with a reduced chance for the cores to shift position. Molten metal may be introduced as has been done in the past. After the metal has cooled, the casting may be removed from the flask, and the cores may be removed from the flask using known methods, such as by shaking the casting. The casting may then be finished, either as has been done traditionally in metal casting operations or the finishing operation may be automated since any fins will have been moved to the exterior of the casting. The present invention includes the method of making cast steel sideframes, bolsters, and other cast metal bodies in accordance with known foundry principles, using the new cores as described, and preferably without support chaplets for the one-piece cores. Standard grades of steel for such products may be used in these processes.

The cores may generally be made in accordance with standard foundry practices. Generally, cope and drag core box portions may be provided, and if automated equipment, such as a blower, is used to fill the core boxes, the cope and drag portions may be provided with a plurality of vents for air escape during filling. The sand used to make the cores may be mixed with a known binding agent. A suitable binder system is available from the Foundry Products Division, Ashland Chemical Company division of Ashland Oil, Inc. of Columbus, Ohio. The binder is sold under the trademark "ISOCURE" and comprises two resins: a first part with having phenolformadehyde polymer blended with solvents and a second part having polymeric MDI (methylene bisphenylisocyanate). The two liquid resins cure to a solid urethane resin. Generally, the phenolic resin first part combines with the polyisocyanate second part in the presence of an amine catalyst (triethylamine) to form the solid urethane. Mixing the resins with the sand should be as recommended by the manufacturer, and should follow standard practices, taking into account the quality of the original sand, whether the sand is fresh or recycled, and other factors. The binder ratio and binder percentage may be adjusted as recommended by the manufacturer. The core boxes for producing the cores may have vents placed and sized as recommended by the manufacturer. It should be understood that the present invention is not limited to any particular binder system, nor to any particular core box design or device for introducing the sand and binder mixture into the core boxes.

Standard industry practices for introducing the mixture of sand and binder may be used, including but not limited to blowing. As will be understood by those skilled in the art, any suitable commercially available equipment may be used for introducing the mixture and curing agent, if any, as well as any improvement in presently available equipment. The equipment should be compatible with the binder system, but otherwise the selection of equipment may vary depending on desired production schedules.

For the blower device used, the blow tube size and position will vary with the core. Blow tubes may be located above the deepest and heaviest sections of the core, with blow tube diameters varying in accordance with standard practice. A blow plate for the center core 82 may have a plurality of conduits with rubber ends for introducing the sand and binder mixture into the core box. The cope and drag portions of the core boxes will have vent areas through which air may escape as the sand and binder mixture is blown into the core box and through which the catalyst gas may escape. The position, number and areas of the vents should be according to standard practice and as recommended by the manufacturers or suppliers of the binder and catalyst and blower equipment.

In making a one-piece core such as the illustrated one-piece center core 82 for the sideframe, traditional cope and drag core boxes may not produce the desired design that has recesses or protrusions that would interfere with pulling the two core box halves apart and removing the core. With such cores, it may be necessary to use a core box such as the drag portion illustrated in FIG. 40 of the '564 patent.

FIGS. 13–19 illustrate certain aspects of a spring seat 200 according a specific embodiment of the present invention. The spring seat 200 is used in place of the spring seat 42 described above. The remainder of the sideframe 18' can be constructed generally as was described above. The spring seat 200 includes a plurality of aerodynamically-shaped spring retainers extending upwardly from its top face 220. The spring retainers 202 are configured to position and support the springs 203 of the spring set 22 on the spring seat 200. The springs are generally represented by the dashed arced lines in FIG. 14. In the illustrated embodiment, the spring seat 200 is configured to support six springs 203. For this purpose, the spring seat 200 includes four of the aerodynamic spring retainers 202, which are centrally positioned on the spring seat 200. The spring seat 200 also includes a plurality of other spring retainers 204, 206, 208 located around the periphery of the spring seat 200. Some or all of these other spring retainers 204, 206, 208 may also incorporate an aerodynamic design, see, e.g. the retainer 208 which has a front face 209 forming an obtuse angle with the top face 220 of the spring seat. Arcuate depressions or recesses 210 formed in the top face of the spring seat, adjacent the spring retainers 202, 204, 206, 204, for receiving the bottom faces of the springs 203.

Figure 14:
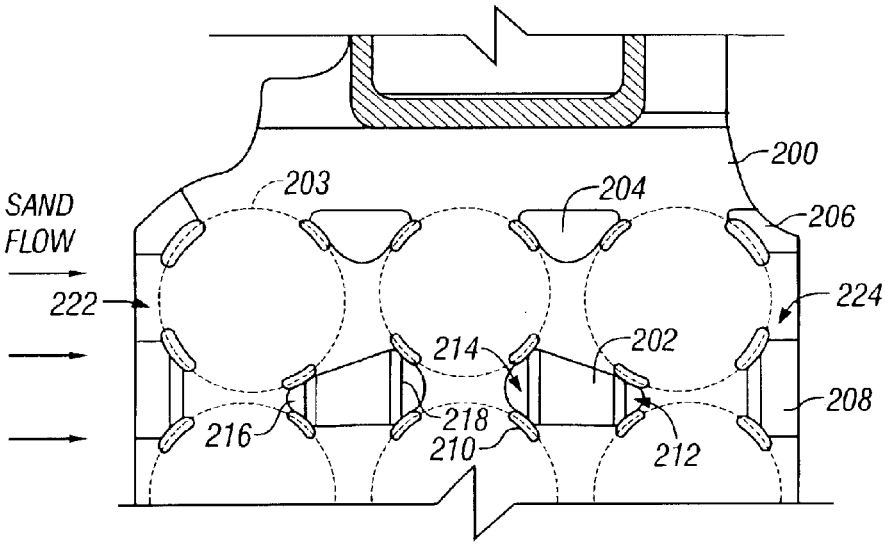
FIG. 14 is a top plan view of a portion of the spring seat of FIG. 13.
Figure 15:
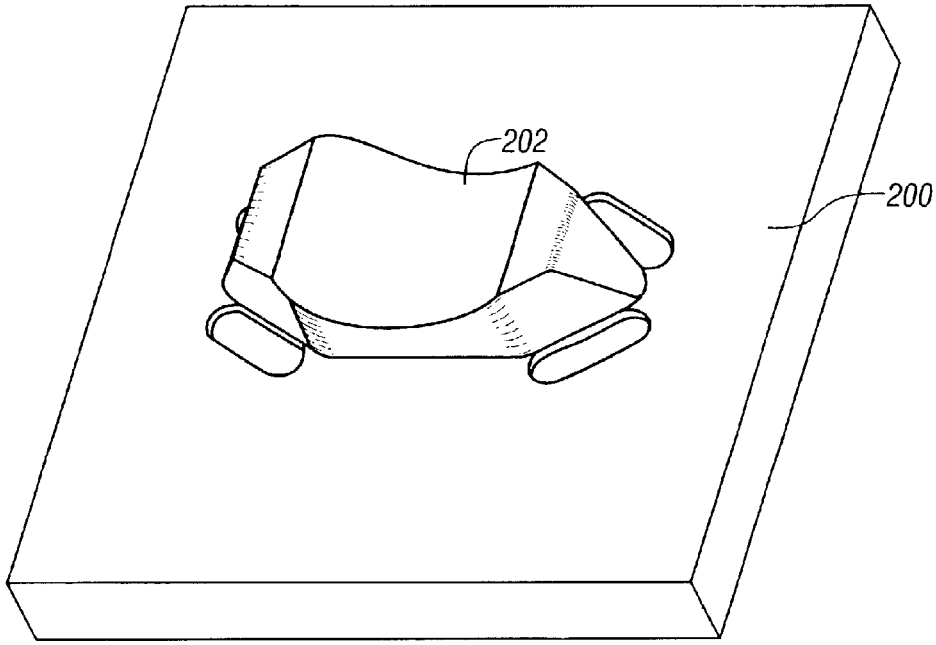
FIG. 15 is perspective view of a spring retainer of the spring seat of FIG. 13.
Figure 16:
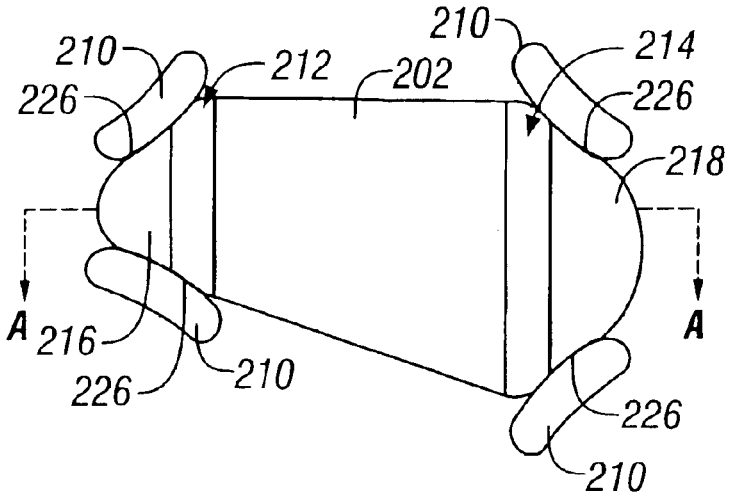
FIG. 16 is a top plan view of the spring retainer of FIG. 15.
Figure 17:
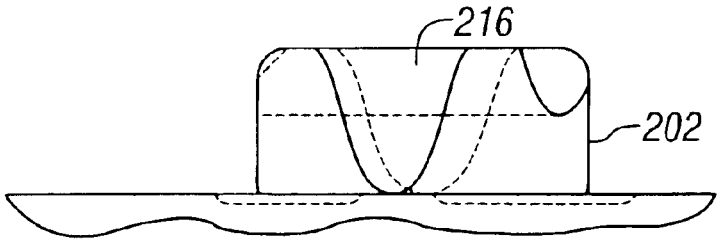
FIG. 17 is a front plan view of the spring retainer of FIG. 15.
Figure 18:
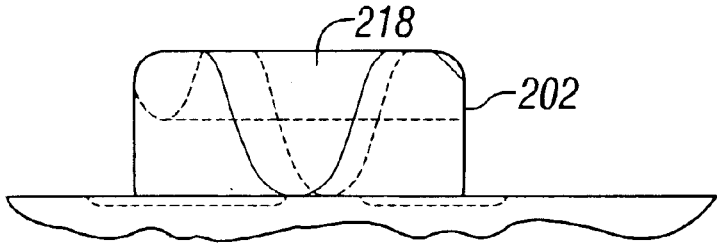
FIG. 18 is a rear plan view of the spring retainer of FIG. 15.

Referring to FIGS. 14 and 16, the spring retainer 202 has a first end 212 and a second end 214. The ends 212, 214 present respective first and second faces 216, 218 that form obtuse angles 217, 219 with the top face 220 of the spring seat 200. For example, the first and second faces 216, 218 may each form an angle of approximately 120° with the top face 220 of the spring seat 200. The angle 217, 219 can be the same for both of the faces 216, 218 or, alternatively, the faces 216, 218 can form different angles with the top face 220.

In the illustrated embodiment, the spring retainer 202 is asymmetric when viewed from the top, see, e.g., FIGS. 14 and 16. Specifically, the first end 212 is narrower than the second end 214. Alternatively, the spring retainers could have a symmetric shape. In the illustrated embodiment, two of the spring retainers 202 (i.e., the lower spring retainers in FIG. 13 and the retainer 202 on the left side of FIG. 14) have their narrower, first ends 212 facing the outer end 222 of the spring seat 200, whereas the other two spring retainers 202 (i.e., the spring retainers 202 in the upper portion of FIG. 13 and the retainer 202 on the right side of FIG. 14) have their first ends 212 facing the inner end 224 of the spring retainer 200. Alternatively, the spring retainers 202 could all face in the same direction. For example, all of the spring retainers 202 could have their first face facing towards the outer end 222 of the spring seat 200.

Each of the spring retainers 202 includes four arcuate side walls or faces 226. (See FIG. 16) The faces 226 are positioned to engage and support different ones of the springs 203 when the spring set 22 is mounted on the spring seat 200. The recesses 210 are formed adjacent to the arcuate faces 226.

Figure 19:
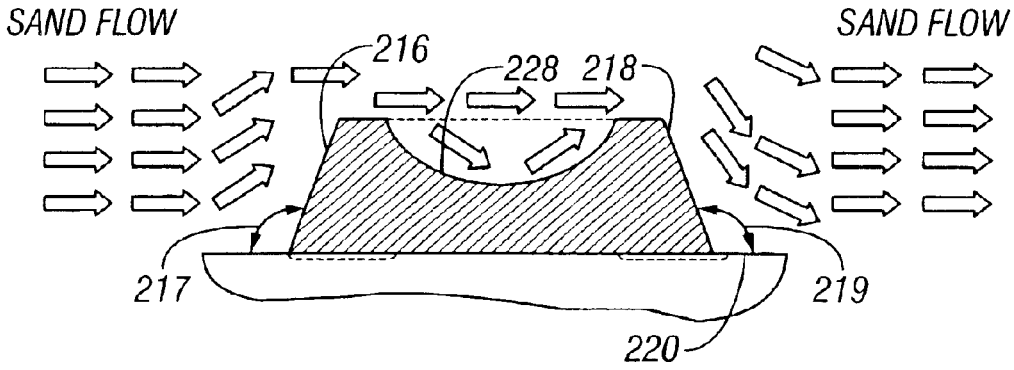
FIG. 19 is a cross sectional view along line A—A of FIG. 16, illustrating formation of a sand core for molding the spring retainer.

The aerodynamic shape of the spring retainer 202 reduces the tendency for voids to form in the sand cores that are used to mold the cast metal sideframes 18'. Specifically, as is shown in FIG. 19, the incorporation of obtuse angles 217, 219 between the first and second faces 216, 218 and the top face 220, as opposed to the perpendicular angles at these locations in the prior spring retainers 1, 2, allows the sand mixture to flow smoothly across the mold during formation of the sand core. As a result of the aerodynamic design and smooth contours of the retainer 202, there is less tendency for the sand to swirl as it passes over the portion of the mold defining the retainer 202. As a result, there is less tendency for voids to form in the sand core.

The spring retainer 202 may be on the order of ¾ of an inch high and preferably have a concave top face 228. Forming the retainer 202 with a concave top face 228 reduces the volume of material comprising the retainer 202. Reducing material volume is beneficial for reducing shrinkage during cooling of the cast metal sideframe 18', thereby reducing the tendency for separations, tears, and cracks to form in the top surface of the spring retainer 202. Alternatively, the spring retainer 202 can be formed with a flat top as is illustrated by the broken line in FIG. 19.

While the invention has been described with reference to a specific embodiment, it will be understood by those skilled in the art that various changes may be made and equivalents may be substituted without departing from the scope of the invention. In addition, many modifications may be made to adapt a particular situation or material to the teachings of the invention without departing from its scope. For example, while the invention had been described in the context of the formation of the spring retainers, it will be appreciated that the principles of the invention may also be applied to the production of other cast metal structures. Therefore, it is intended that the invention not be limited to the particular embodiment disclosed, but that the invention will include all embodiments falling within the scope of the invention.

What is claimed is:

1. An improved cast metal sideframe for use in a railway car truck, the sideframe having a spring seat for supporting springs from a spring set, the sideframe being molded using a sand core that provides a negative impression of the sideframe, the improvement comprising:

a plurality of aerodynamically-shaped spring retainers formed on the spring seat, the spring retainers being configured to position and support the springs from the spring set, whereby the aerodynamic shape of the spring retainers reduces the tendency for voids to form in the sand core that is used to cast the sideframe, wherein at least some of the aerodynamically-shaped spring retainers have a concave top face.

2. The improved side frame of claim 1, wherein the aerodynamic spring retainers include respective side walls, portions of which extend at an obtuse angle from a top surface of the spring seat so as to reduce the tendency for voids to form in the sand core.

3. The improved sideframe of claim 1, wherein the spring seat has an outer end, an inner end and a top face, and wherein at least some of the aerodynamically-shaped spring retainers have a respective first face facing the outer end of the spring seat and a respective second face facing the inner end of the spring seat, the first and second faces forming obtuse angles with respect to the top face of the spring seat.

4. An improved cast metal sideframe for use in a railway car truck, the sideframe having a spring seat for supporting springs from a spring set, the spring seat having an outer end, an inner end and a top face, the improvement comprising:

a plurality of aerodynamically-shaped spring retainers formed on the spring seat, the spring retainers being configured to position and support springs from the spring set, each spring retainer having a first face facing the outer end of the spring seat and a second face facing the inner end of the spring seat, the first and second faces of the spring retainer forming obtuse angles with respect to the top face of the spring seat, wherein at least some of the aerodynamically-shaped spring retainers have a concave top face.

5. The improved sideframe of claim 4, wherein at least some of the aerodynamically-shaped spring retainers have arcuate side walls for engaging and supporting the springs from a spring set.

6. The improved sideframe of claim 4, further comprising arcuate recesses formed in the top face of the spring seat adjacent the arcuate side walls, the arcuate recesses being positioned and configured to receive the bottom faces of springs from the spring set.

7. The improved sideframe of claim 4, wherein at least some of the spring retainers are asymmetric when viewed from the top.

8. The improved sideframe of claim 4, wherein the angles between the first faces of the spring retainers and the top face of the spring seat is on the order of 120°.

9. The improved sideframe of claim 4, wherein the angle between the second faces of the spring retainers and the top face of the spring seat is the order of 120°.

10. An improved cast metal sideframe for use in a railway car truck, the sideframe having a spring seat for holding a spring set to support a bolster received in the bolster opening, the spring seat having an outer end, an inner end and a top face, the improvement comprising:

a plurality of spring retainers formed on the spring seat, at least some of the spring retainers having concave top faces, whereby the volume of material comprising the retainer is reduced.

11. The improved sideframe of claim 10, wherein at least some of the spring retainers are aerodynamically-shaped to reduce the tendency for voids to form in sand core that is used to cast the sideframe.

12. The improved sideframe of claim 11, wherein the each of the aerodynamically-shaped spring retainers includes a respective first face facing the outer end of the spring seat and a respective second face facing the inner end of the spring seat, the first and second faces forming obtuse angles with respect to the top face of the spring seat.

13. The improved sideframe of claim 12, wherein the angles between the first faces of the spring retainers and the top face of the spring seat is on the order of 120°.

14. The improved sideframe of claim 10, wherein at least some of the spring retainers have arcuate side walls for engaging and supporting different springs from a spring set that is mounted on the spring seat.

15. The improved sideframe of claim 14, further comprising arcuate recesses formed in the top face of the spring seat adjacent the arcuate side walls, the arcuate recesses being positioned and configured to receive the bottom faces of springs from the spring set.

16. The improved sideframe of claim 10, wherein at least some of the spring retainers are asymmetric when viewed from the top.

* * * * *